US007462584B2

(12) United States Patent
Küpper et al.

(10) Patent No.: US 7,462,584 B2
(45) **Date of Patent: *Dec. 9, 2008**

(54) LUBRICANT CONCENTRATE BASED ON ALCOHOLS

(75) Inventors: Stefan Küpper, Langefeld (DE); Michael Schneider, Grevenbroich (DE)

(73) Assignee: Ecolab Inc., St. Paul, MN (US)

( * ) Notice: Subject to any disclaimer, the term of this patent is extended or adjusted under 35 U.S.C. 154(b) by 471 days.

This patent is subject to a terminal disclaimer.

(21) Appl. No.: 10/467,702

(22) PCT Filed: Feb. 6, 2002

(86) PCT No.: PCT/EP02/01193

§ 371 (c)(1),
(2), (4) Date: Aug. 15, 2003

(87) PCT Pub. No.: WO02/064713

PCT Pub. Date: Aug. 22, 2002

(65) Prior Publication Data

US 2004/0097383 A1 May 20, 2004

(30) Foreign Application Priority Data

Feb. 15, 2001 (DE) ..... 101 06 954

(51) Int. Cl.

| | |
|---|---|
| ***C10M 173/02*** | (2006.01) |
| ***C10M 169/04*** | (2006.01) |
| ***C10M 131/10*** | (2006.01) |
| ***C10M 129/26*** | (2006.01) |
| ***C10M 133/06*** | (2006.01) |

(52) U.S. Cl. ..... 508/530; 508/583; 508/459

(58) Field of Classification Search ..... 508/233, 508/530, 412, 463, 459, 486, 545, 583; 184/12
See application file for complete search history.

(56) References Cited

U.S. PATENT DOCUMENTS

| | | | | |
|---|---|---|---|---|
| 3,374,171 | A * | 3/1968 | Davis | 508/158 |
| 4,434,066 | A | 2/1984 | Lewis | |
| 5,244,589 | A | 9/1993 | Liu et al. | |
| 5,534,172 | A * | 7/1996 | Perry et al. | 508/156 |
| 5,863,874 | A * | 1/1999 | Person Hei et al. | 508/521 |
| 5,925,601 | A * | 7/1999 | McSherry et al. | 508/425 |
| 6,509,302 | B2 * | 1/2003 | Li et al. | 508/208 |
| 2005/0070448 | A1 * | 3/2005 | Kupper et al. | 508/463 |

FOREIGN PATENT DOCUMENTS

| | | |
|---|---|---|
| DE | 3631953 | 3/1988 |
| DE | 3905548 | 9/1990 |
| DE | 4206506 | 9/1993 |
| DE | 69117537 | 7/1996 |
| DE | 19642598 | 4/1998 |
| DE | 19959315 | 12/1999 |
| DE | 19942535 | 3/2001 |
| EP | 0538916 | 4/1993 |
| EP | 0372628 | 12/1993 |
| WO | WO94/03562 | 2/1994 |
| WO | WO94/19438 | 9/1994 |
| WO | WO01/07545 | 2/2001 |

OTHER PUBLICATIONS

Gilbert, Peter, "*Conveyor Lubrication in Dairies, Breweries and Beverage Plants*", Klensan (Pty) Ltd., S.A. Food Review—Dec. 1981/Jan. 1982, pp. 27-28, 2 pages.
Gorton, Hugh J. Ph.D. and Taylour, Jim M. PhD. C Chem, "*The Development of New Conveyor Lubricant Technology*", MBAA Technical Quarterly, vol. 30, pp. 18-22, 1993, 5 pages.
Henkel Ecolab, "*Conveyor Lubrication*", 27 Food Ireland, 1 page.
"*Maintaining hygiene on filler line conveyor track*", Packaging Hygiene, 2 pages.

* cited by examiner

*Primary Examiner*—Glenn Caldarola
*Assistant Examiner*—Jim Goloboy
(74) *Attorney, Agent, or Firm*—Andrew D. Sorensen; Anneliesse S. Mayer

(57) ABSTRACT

Lubricant concentrate for conveyors containing at least one alcohol component not containing nitrogen, selected from monohydroxy, dihydroxy and trihydroxy compounds as well as their esters and ethers, and in addition at least one further component selected from a) nitrogen-containing, organic, preferably aliphatic compounds with fewer than 14 C atoms in the molecule and fewer than 8 C atoms in the molecule directly joined to one another, and/or
b) an organic acid with 1 to 18, preferably 1 to 10 C atoms in the molecule.

26 Claims, No Drawings

LUBRICANT CONCENTRATE BASED ON ALCOHOLS

The present invention relates to lubricant concentrates based on selected alcohols in combination with at least one selected nitrogen compound and/or one selected organic carboxylic acid. The present invention also includes the use of these lubricant concentrates, associated processes, and a system in which these lubricant concentrates are a constituent.

In the foodstuffs industry, in particular in drinks factories, the containers to be filled at the filling plants are transported via transporting devices of widely varying design and materials, for example via plate conveyors or chain-like arrangements, which hereinafter will generally be referred to as transporting chains. The transporting devices constitute the link between the various optional treatment stages of the filling process, such as for example unpacking machinery, bottle cleaning machinery, filling machinery, bottle closing machinery, labelling machinery, packing machinery etc. The containers may be of widely varying types and shapes, in particular glass and plastics bottles, cans, glasses, drums, drinks containers (kegs), and paper and cardboard containers. In order to ensure a satisfactory operation the transporting chains must be suitably lubricated so as to avoid excessive contact friction with the containers. Dilute aqueous solutions containing suitable friction-reducing active components are normally used for the lubrication. The transporting chains are brought into contact with the aqueous solutions, for example by immersion or by spraying, in which case one then talks of immersion lubrication plants or automatic belt lubrication systems or central chain lubrication systems.

The chain lubricants previously used as lubricants are generally based on fatty acids in the form of their water-soluble alkali metal or alkanolamine salts, or on fatty amines, preferably in the form of their organic or inorganic salts.

Although both classes of substances can be used without any problem in immersion lubrication, they manifest a number of disadvantages when used in the current conventional central lubrication systems. For example, DE-A-23 13 330 describes lubricants based on soaps that contain aqueous mixtures of $C_{16}$-$C_{18}$ fatty acid salts and surfactants. Such lubricants based on soaps have the following disadvantages however:

1. A reaction takes place between the water hardness, i.e. the alkaline earth ions, and other water constituents, with the formation of sparingly soluble metal soaps, the so-called primary alkaline earth soaps.
2. A reaction takes place between these lubricants based on soaps and carbon dioxide dissolved in water or in the product to be filled.
3. The resultant application solution always promotes microbial contamination.
4. When using hard water ion exchangers are required to soften the water, which represents an additional source of microbial contamination (and therefore is hardly acceptable in practice), or it is necessary to use highly active products containing complexing agents, which again is unacceptable for ecological reasons.
5. There is increased foam formation, which can in particular cause problems with the "bottle inspector" (automatic bottle inspection equipment) and as a result causes a significant wetting of the transporting containers.
6. Most of these products contain solvent.
7. The cleaning action of these products is poor, which means that a separate cleaning is necessary.
8. Such lubricant preparations based on soaps have a pH-dependent effectiveness.
9. Lubricant preparations based on soaps furthermore exhibit a water temperature dependence.

10. Lubricants based on soaps have only a poor storage stability, in particular at low temperatures.
11. The EDTA (ethylenediamine tetraacetate) contained in many products is, as is known, difficultly biodegradable.
12. Such lubricant preparations based on soaps are not suitable for all transporting materials made of plastics since stress cracking corrosion of the transporting material occurs in many cases when using these preparations.

Besides lubricants based on soaps, lubricants based on fatty amines are also mainly used. For example, DE-A-36 31 953 describes a process for the lubrication of chain-shaped bottle conveyors in drinks filling plants, in particular in breweries, as well as cleaning the conveyor belts by means of a liquid cleansing agent, which process is characterized in that the chain-shaped bottle conveyors are lubricated with belt lubricants based on neutralized primary fatty amines that preferably have 12 to 18 C atoms and that contain an unsaturated proportion of more than 10%.

From EP-A-0 372 628 fatty amine derivates of the formulae

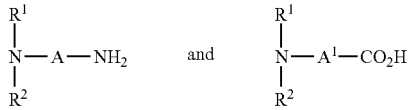

are known as lubricants, wherein $R^1$ denotes a saturated or unsaturated, branched or linear alkyl group with 8 to 22 C atoms;

$R^2$ denotes hydrogen, an alkyl or hydroxyalkyl group with 1 to 4 C atoms, or $-A-NH_2$;

A denotes a linear or branched alkenyl group with 1 to 8 C atoms; and $A^1$ denotes a linear or branched alkenyl group with 2 to 4 C atoms.

Furthermore lubricants based on N-alkylated fatty amine derivatives that contain at least one secondary and/or tertiary amine are known from DE-A-39 05 548.

The following are known from DE-A-42 06 506: Soap-free lubricants based on amphoteric compounds, primary, secondary and/or tertiary amines and/or salts of such amines of the general formulae (I), (IIa), (IIb), (IIIa), (IIIb), (IIIc), (IVa) and (IVb)

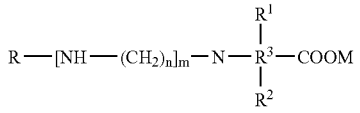

(I)

$R^4—NH—R^5$ (IIa)

$R^4—N^+H_2—R^5X^-$ (IIb)

$R^4—NH—(CH_2)_3NH_2$ (IIIa)

$R^4—NH—(CH_2)_3N^+H_32X^-$ (IIIb)

$R^4—N^+H_2—(CH_2)_3—N^+H_32X^-$ (IIIc)

$R^4—NR^7R^8$ (IVa)

and/or $R^4—N^+HR^7R^8X^-$ wherein

R denotes a saturated or singly or multiply unsaturated, linear or branched alkyl radical with 6 to 22 C atoms that may optionally be substituted by —OH, —$NH_2$, —NH—, —CO—, —$(CH_2CH_2O)_1$— or —$(CH_2CH_2CH_2O)_1$—, $R^1$ denotes hydrogen, an alkyl radical with 1 to 4 C atoms, a hydroxyalkyl radical with 1 to 4 C atoms, or a —$R^3$COOM radical $R^2$ denotes, only in the case where M represents a negative charge, hydrogen, an alkyl radical with 1 to 4 C atoms, or a hydroxyalkyl radical with 1 to 4 C atoms, $R^3$ denotes a saturated or singly or multiply unsaturated, linear or branched alkyl radical with 1 to 12 C atoms that may optionally be substituted by —OH, —$NH_2$, —NH—, —CO—, —$(CH_2CH_2O)_1$— or —$(CH_2CH_2CH_2O)_1$—, $R^4$ denotes a substituted or unsubstituted, linear or branched, saturated or singly or multiply unsaturated alkyl radical with 6 to 22 C atoms that may contain, as substituents, at least one amine, imine, hydroxy, halogen and/or carboxy radical, a substituted or unsubstituted phenyl radical that may contain, as substituent, at least one amine, imine, hydroxy, halogen, carboxy and/or a linear or branched, saturated or singly or multiply unsaturated alkyl radical with 6 to 22 C atoms, $R^5$ denotes hydrogen or, independently of $R^4$, a radical $R^4$, $X^-$ denotes an anion from the group comprising amidosulfanate, nitrate, halide, sulfate, hydrogen carbonate, carbonate, phosphate or $R^6$—$COO^-$, wherein $R^6$ denotes hydrogen, a substituted or unsubstituted, linear or branched alkyl radical with 1 to 20 C atoms or alkenyl radical with 2 to 20 C atoms that may contain, as substituent, at least one hydroxy, amine or imine radical, or denotes a substituted or unsubstituted phenyl radical that may contain, as substituent, an alkyl radical with 1 to 20 C atoms, and $R^7$ and $R^8$ in each case denote, independently of one another, a substituted or unsubstituted, linear or branched alkyl radical with 1 to 20 C atoms or alkenyl radical with 2 to 20 C atoms that may contain as substituents at least one hydroxy, amine or imine radical, or denote a substituted or unsubstituted phenyl radical that may contain as substituent an alkyl radical with 1 to 20 C atoms, M denotes hydrogen, an alkali metal, ammonium, an alkyl radical with 1 to 4 C atoms, a benzyl radical, or a negative charge, n denotes an integer in the range from 1 to 12, m denotes an integer in the range from 0 to 5, and l denotes a number in the range from 0 to 5, containing alklydimethylamine oxides and/or alkyl oligoglycosides as non-ionic surfactants.

EP-B-629 234 discloses a lubricant combination consisting of a) one or more compounds of the formula

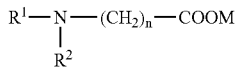

wherein $R^1$ denotes a saturated or singly or multiply unsaturated, linear or branched alkyl radical with 6 to 22 C atoms that may optionally be substituted by —OH, —$NH_2$, —NH—, —CO—, halogen or a carboxyl radical, $R^2$ denotes a carboxyl radical with 2 to 7 C atoms, M denotes hydrogen, an alkali metal, ammonium, an alkyl radical with 1 to 4 C atoms or a benzyl radical, and n denotes an integer in the range from 1 to 6, b) at least one organic carboxylic acid selected from monobasic or polybasic, saturated or singly or multiply unsaturated carboxylic acids with 2 to 22 C atoms, c) optionally water and auxiliary additives and/or substances.

WO 94/03562 describes a lubricant concentrate based on fatty amines and optionally conventional diluents or auxiliary substances and additives, characterized in that it contains at least one polyamine derivative of a fatty amine and/or a salt of such an amine, the proportion of the aforementioned polyamine derivatives of fatty amines in the overall formulation being 1 to 100 wt. %.

According to a preferred embodiment of WO 94/03562 this lubricant concentrate contains at least one polyamine derivative of a fatty amine of the general formula $$R—A—(CH_2)_k—NH—[(CH_2)_l—NH]_y—(CH_2)_m—NH_2.(H^+X^-)_n$$

wherein

R denotes a substituted or unsubstituted, linear or branched, saturated or singly or multiply unsaturated alkyl radical with 6 to 22 C atoms, wherein the substituents are selected from amino, imino, hydroxy, halogen and carboxy, or a substituted or unsubstituted phenyl radical, wherein the substituents are selected from amino, imino, hydroxy, halogen, carboxy and a linear or branched, saturated or singly or multiply unsaturated alkyl radical with 6 to 22 C atoms;

A denotes either —NH— or —O—, $X^-$ denotes an anion of an inorganic or organic acid, k, l, m independently of one another denote an integer in the range from 1 to 6;

y in the case where A=—NH— denotes 0, 1, 2 or 3 and in the case where A=—O— denotes 1, 2, 3 or 4, n is an integer from 0 to 6.

In some filling plants lubricants based on polytetra-fluoroethylene are used. These are available in the form of dispersions and are not, as is normally the case, applied to the chains via nozzles, but instead are applied via brushes. These lubricants have the advantage that they achieve a substantial reduction in the friction between the conveyors and transported products. Furthermore the polytetrafluoroethylene adheres very strongly to the chains. A disadvantage that has been found in practice however is that the overall hygienic state as regards microbial contamination and dirtiness of the transporting chains deteriorated. This occurred to such an extent that the effectiveness of the lubricant deteriorated over time as a result of the increased contamination.

A further disadvantage that was found was that the dispersions of polytetrafluoroethylene were not stable on storage and separated out over time. As a consequence it was found that, over a prolonged period, varying amounts of active component were present on the transporting chains.

When attempting to clean the transporting chains it was found that the lubricant layer was very difficult to remove from the transporting chains.

When checking the compatibility of polytetrafluoroethylene dispersions as regards their compatibility with plastics, it was also found that they produce stress cracks on PET bottles.

The lubricants that are normally used have the disadvantage that they form a strongly adhering film on the transporting chains that cannot easily be removed merely by rinsing with water.

Residues and abrasion products may accumulate in this film and lead to hygiene problems and operational malfunctions during operation.

The non-prior-published application DE 199 42 535.3 provides lubricants based on polyhydroxy compounds that are hydrophilic on account of their molecular structure and at the same time improve the lubrication efficiency compared to the amines that are normally used as lubricants.

In this connection polyhydroxy compounds that are selected from alkanediols or alkanetriols are mentioned as being particularly preferred, glycerol, or its polymers as well as its esters and ethers, being most particularly preferred.

At no place in the non-prior-published application DE 199 42 535.3 is there any reference to combinations of alcohols with organic nitrogen-containing compounds with fewer than 10 C atoms in the molecule and/or with organic carboxylic acids with 1 to 10 C atoms.

The present invention accordingly provides a lubricant concentrate containing at least one alcohol component not containing nitrogen, selected from monohydroxy, dihydroxy and trihydroxy compounds as well as their esters and ethers, and in addition at least one further component selected from a) nitrogen-containing, organic, preferably aliphatic compounds with fewer than 14 C atoms in the molecule and fewer than 8 C atoms in the molecule directly joined to one another, and/or b) an organic acid with 1 to 18, preferably 1 to 10 C atoms in the molecule or its salts.

It is preferred in this connection that the proportion of the alcohol component, referred to the total concentrate, is greater than 20 wt. %, particularly preferably greater than 25 wt. % and most particularly preferably greater than 50 wt. %, and especially greater than 70 wt. %.

Preferably at least glycerol is present as alcohol component in the lubricant concentrate according to the invention.

It is also preferred if the nitrogen-containing compound a) present in the lubricant concentrate according to the invention has fewer than 7 C atoms in the molecule.

Preferably the nitrogen-containing compound a) present in the lubricant concentrate according to the invention contains additional OH groups in the molecule, the said concentrate particularly preferably including as nitrogen-containing compound a) a compound of the formula I

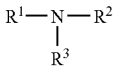

(1)

wherein the radicals $R^1$, $R^2$, $R^3$ may independently of one another be H or $—(CH_2)_n—OH$ where n=1 or 2, and wherein not all radicals $R^1$, $R^2$, $R^3$ may simultaneously be H.

In this connection it is most particularly preferred if monoethanolamine and/or triethanolamine is/are present as nitrogen-containing compound a).

A preferred embodiment of the lubricant concentration according to the invention is where the proportion of nitrogen-containing compound a), referred to the total concentrate, is 0.1 to 20 wt. %, particularly preferably 0.2 to 10 wt. %.

It is also preferred if the lubricant concentration according to the invention contains, referred to the total concentrate, 0.1 to 20 wt. %, particularly preferably 0.2 to 10 wt. %, of the organic carboxylic acid b).

Acetic acid and/or caproic acid is/are contained as preferred organic carboxylic acid b) in the lubricant concentrate according to the invention.

The lubricant concentrate according to the invention is preferably available as a liquid, solution, gel, emulsion, paste or dispersion.

Depending on the requirements of the particular application, it is preferred if the lubricant concentrate according to the invention additionally contains at least one antimicrobial component selected from the groups comprising alcohols, aldehydes, antimicrobial acids, carboxylic acid esters, acid amides, phenols, phenol derivatives, diphenyls, diphenylalkanes, urea derivatives, oxygen acetals, nitrogen acetals and also formals, benzamidines, isothiazolines, phthalimide derivatives, pyridine derivatives, antimicrobial surfactants, guanidines, antimicrobial amphoteric compounds, quinolines, 1,2-dibromo-2,4-dicyanobutane, iodo-2-propynylbutyl carbamate, iodine, iodophores, peroxides or peracids.

Besides the aforementioned substances the lubricant concentrates according to the present invention may additionally also contain components selected from fluorine and silicone compounds, the fluorine compound preferably being selected from the groups comprising perfluorinated or partially fluorinated monomeric organic compounds, pure and mixed dimers and oligomers that are based on at least one perfluorinated or partially fluorinated organic monomer, and pure and mixed polymers that are based on at least one perfluorinated or partially fluorinated organic monomer. The constituents that are particularly preferred in this connection are disclosed in the non-prior-published application DE 199 42 535.3.

The silicone compounds are preferably selected from the group comprising polysiloxanes and particularly preferably from the groups comprising linear, branched, cyclic and crosslinked polysiloxanes.

Depending on the particular requirement, the lubricant concentrates according to the invention may contain further components selected from the groups comprising surfactants and solution promoters, in which connection it is particularly preferred if at least one alkylpolyglycoside is included as surfactant. Further constituents may be fatty alkylamines with more than 10 C atoms and/or their alkoxylates, in particular coconut oil amine ethoxylate and/or imidazoline compounds and/or amphoteric surfactants and/or non-ionic surfactants and/or ether carboxylic acids and/or ether amine compounds with more than 10 C atoms.

The invention also provides for the use of a lubricant concentrate according to the invention or a dilute solution of a lubricant concentrate according to the invention in the transportation of plastics, cardboard, metal or glass containers principally in the foodstuffs-processing industry, wherein the plastics containers to be transported are preferably those that contain at least one polymer selected from the groups comprising polyethylene terephthalates (PET), polyethylene naphthenates (PEN), polycarbonates (PC) and PVC, and are most particularly preferably PET drinks bottles.

In a preferred embodiment of the use according to the invention additional antimicrobial active components that are particularly preferably selected from organic peracids, chlorine dioxide or ozone, are added separately during use.

It is also preferred if, in the use according to the invention, the lubricant concentrates are applied, optionally after dilution with water, to the conveyors by means of an auxiliary device chosen for example from brushes, sponges, rollers, cloths, rags, small brushes, wipers, rubber applicators or spray devices, the lubricant concentrate preferably being used in undiluted form, i.e. with a dilution factor of 0, or in diluted form with a dilution factor down to below 10,000.

Particularly preferred dilution factors are between 0 and 10, and most particularly preferred between 0 and 2.

The present invention furthermore provides for a process for maintaining the smooth running of transporting chains by the computer-controlled application of a lubricant concentrate according to the invention that is preferably diluted before application, to predetermined positions of the transporting chains, as well as the periodic application of chain cleaning agents and/or rinsing water or flushing water.

In this connection it is preferred to use combined nozzle devices for the application of the lubricant according to the invention and the chain cleaning agent.

The present invention furthermore provides a system for maintaining the smooth running of transporting chains, containing a lubricant concentrate according to the invention and an apparatus for the lubrication and cleaning of transporting chains and a chain cleaning agent, wherein the apparatus for lubricating and cleaning transporting chains includes at least one tank for holding the lubricant together with associated conveying pump and feed line to the lubricant application device(s) as well as a tank for holding the chain cleaning agent together with associated conveying pump and feed line to the cleaning agent application device(s), as well as a regulating device controlling the respective application cycles and the respective feed amounts.

In this connection it is particularly preferred if the lubricant application device as well as the cleaning agent application device are arranged as a functional unit on a common nozzle holder.

In a most particularly preferred embodiment of the system according to the invention the lubricant application device is designed as twin-substance nozzle operated by compressed air.

EXAMPLES

When using alcohol-based lubricants problems arise with regard to lubrication during transportation, in particular of glass bottles.

These problems may be solved by formulations according to the invention. For this purpose a glycerol-based agent V1 of the prior art was compared with a glycerol-based agent B1 according to the invention. Both agents were tested as regards their lubricating action on different materials for drinks bottles.

The lubricating action can be determined by measuring the coefficient of friction. The coefficient of friction between the drinks bottle and transporting chains is defined according to the present invention as the ratio of the tractive weight that is for example exerted on a spring balance when an attempt is made to retain a drinks bottle with the transporting chains running, to the weight of the bottle itself. In the present test the transporting chains were made of stainless steel.

In the relevant experiments 25 ml of the agent B1 according to the invention and of the comparison agent V1 were distributed over the transporting chains using a rag. The coefficient of friction between the bottles and transporting chain was then measured over a period of 1 hour. The results are shown in the following Table.

TABLE

Lubricating Tests with Alcohol-Based Agents

| Constituent | B1 [wt. %] | B2 [wt. %] | B3 [wt. %] | V1 [wt. %] |
|---|---|---|---|---|
| Glycerol | 70 | 50 | 30 | 70 |
| Alkylglucoside | 0 | 0 | 0 | 2 |
| Silicone emulsion | 0 | 0 | 0 | 2 |
| Triethanolamine | 2 | 2 | 2 | 0 |
| Caprylic acid | 2 | 2 | 2 | 0 |
| Water | 26 | 46 | 66 | 26 |
| Lubricating effect | | | | |
| Glass | | $\mu < 0.1$: very good | | Bottle falls over: very poor, no measurable coefficient of friction |
| PET | | $\mu < 0.1$: very good | | $\mu < 0.1$: very good |
| Cardboard | | $\mu < 0.1$: very good | | $\mu < 0.1$: very good |

For the sake of completeness, it may be mentioned at this point that the agents B1, B2 and B3 are sufficiently microbiologically stable, and accordingly although it is possible to add preservatives such a measure is not however absolutely necessary.

The invention claimed is:

1. A foodstuff conveyor lubricant concentrate composition comprising:

a. at least about 50 wt. % glycerol;

b. at least one nitrogen compound having the formula

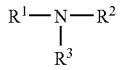

wherein $R^1$, $R^2$, and $R^3$ are selected from the group consisting of H and $(CH_2)_n$—OH where n may be 1 or 2 and wherein not all of $R^1$, $R^2$, and $R^3$ are H; and c. at least one organic acid having from 1 to 10 carbon atoms;

wherein the composition is free of an alkylpolyglycoside or a fatty acid in the form of a water soluble alkali metal or alkanolamine salt.

2. The composition of claim 1, wherein the nitrogen compound is present from about 0.1 wt. % to about 20 wt. %.

3. The composition of claim 1, wherein the organic acid is present from about 0.1 wt. % to about 20 wt. %.

4. The composition of claim 1, wherein the nitrogen compound is selected from the group consisting of monoethanolamine, triethanolamine, and mixtures thereof.

5. The composition of claim 1, wherein the organic acid is selected from the group consisting of acetic acid, caproic acid, and mixtures thereof.

6. The composition of claim 1, wherein the composition is a liquid, a gel, an emulsion, a paste, or a dispersion.

7. The composition of claim 1, further comprising an antimicrobial agent.

8. The composition of claim 7, wherein the antimicrobial agent is selected from the group consisting of alcohols, aldehydes, antimicrobial acids, carboxylic acid esters, acid amides, phenols, phenol derivatives, diphenyls, diphenylalkanes, urea derivatives, oxygen-nitrogen acetals, oxygen-nitrogen formals, benzamidines, isothiazolines, phthalimide derivatives, pyridine derivatives, antimicrobial surfactants, guanidines, antimicrobial amphoteric compounds, quinolines, 1,2-dibromo-2,4-dicyanobutane, iodo-2-propynlbutyl carbamate, iodine, iodophores, peroxides, peracids, and mixtures thereof.

9. The composition of claim 1, wherein the composition is diluted with water to form a dilute solution.

10. The composition of claim 9, wherein the dilution factor is below 10,000.

11. The composition of claim 10, wherein the dilution factor is from 0 to 10.

12. A method of lubricating a conveyor for conveying beverage containers comprising:

a. providing a lubricant concentrate comprising:

i. at least about 50 wt. % glycerol;

ii. at least one nitrogen compound having the formula

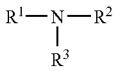

wherein $R^1$, $R^2$, and $R^3$ are selected from the group consisting of H and $(CH_2)_n$—OH where n may be 1 or 2 and wherein not all of $R^1$, $R^2$, and $R^3$ are H; and iii. at least one organic acid having from 1 to 10 carbon atoms;

wherein the concentrate is free of an alkylpolyglycoside or fatty acid the form of a water soluble alkali metal or alkanolamine salt;

b. diluting the concentrate to form a dilute solution; and c. applying the dilute solution to the conveyor.

13. The method of claim 12, wherein the nitrogen compound is present from about 0.1 wt. % to about 20 wt. %.

14. The method of claim 12, wherein the organic acid is present from about 0.1 wt. % to about 20 wt. %.

15. The method of claim 12, wherein the nitrogen compound is selected from the group consisting of monoethanolamine, triethanolamine, and mixtures thereof.

16. The method of claim 12, wherein the organic acid is selected from the group consisting of acetic acid, caproic acid, and mixtures thereof.

17. The method of claim 12, wherein the lubricant concentrate is a liquid, a gel, an emulsion, a paste, or a dispersion.

18. The method of claim 12, further comprising an antimicrobial agent.

19. The method of claim 18, wherein the antimicrobial agent is selected from the group consisting of alcohols, aldehydes, antimicrobial acids, carboxylic acid esters, acid amides, phenols, phenol derivatives, diphenyls, diphenylalkanes, urea derivatives, oxygen-nitrogen acetals, oxygen-nitrogen formals, benzamidines, isothiazolines, phthalimide derivatives, pyridine derivatives, antimicrobial surfactants, guanidines, antimicrobial amphoteric compounds, quinolines, 1,2-dibromo-2,4-dicyanobutane, iodo-2-propynlbutyl carbamate, iodine, iodophores, peroxides, peracids, and mixtures thereof.

20. The method of claim 12, wherein the concentrate is diluted to a dilution factor below 10,000.

21. The method of claim 20, wherein the dilution factor is from 0 to 10.

22. The method of claim 12, wherein the dilute solution is applied to the beverage containers.

23. The method of claim 12, wherein the applying step is controlled using a computer.

24. The method of claim 12, wherein the lubricant concentrate is diluted using water.

25. The method of claim 12, further comprising the step of cleaning the conveyor with a cleaning agent.

26. The method of claim 12, wherein the dilute solution is applied using a nozzle.

* * * * *